73-152 SR
8/31/82 OR 4,346,592

United States Patent [19]
Fertl et al.
[11] 4,346,592
[45] Aug. 31, 1982

[54] METHOD FOR DETERMINING EFFECTIVE RESERVOIR POROSITY

[75] Inventors: Walter H. Fertl, Houston, Tex.; Marvin R. DeVries, Tulsa, Okla.

[73] Assignee: Dresser Industries, Inc., Dallas, Tex.

[21] Appl. No.: 183,772

[22] Filed: Sep. 3, 1980

Related U.S. Application Data

[63] Continuation-in-part of Ser. No. 18,686, Mar. 6, 1979, abandoned.

[51] Int. Cl.[3] ..... E21B 49/00
[52] U.S. Cl. ..... 73/152
[58] Field of Search ..... 73/152; 250/256, 262, 250/264, 265, 266; 364/422

[56] References Cited

U.S. PATENT DOCUMENTS

| | | | |
|---|---|---|---|
| 3,500,683 | 3/1970 | Hoyle | 73/152 |
| 3,638,484 | 2/1972 | Tixier | 73/152 |
| 3,940,610 | 2/1976 | Dennis et al. | 250/253 |
| 3,990,297 | 11/1976 | Pelet et al. | 73/152 |

*Primary Examiner*—Jerry W. Myracle
*Attorney, Agent, or Firm*—Richard M. Byron; Patrick H. McCollum

[57] ABSTRACT

A clay content curve, for the borehole under investigation is developed through logging procedures such as a gamma ray log or a spectral gamma ray log. Additionally, compaction trend curves based upon historic logging data are obtained for the geologic area of interest. Information provided by the total porosity trend curve is corrected using a function of the shaliness indicator curve. This correction allows the deviation of an effective porosity log for the reservoir which can be recorded or can be used to edit porosity logs.

15 Claims, 2 Drawing Figures

METHOD FOR DETERMINING EFFECTIVE RESERVOIR POROSITY

CROSS-REFERENCE TO RELATED APPLICATIONS

This application is a continuation-in-part of my copending application Ser. No. 018,686, filed Mar. 6, 1979, now abandoned.

BACKGROUND OF THE INVENTION

This invention relates generally to well logging methods and apparatus for determining the porosity of subsurface earth formations traversed by a borehole and more particularly, to a method and an apparatus for deriving the effective reservoir porosity in a given geologic province.

In attempting to determine the location of oil and gas situated in subsurface earth formations various parameters must be determined, such as porosity, permeability and lithology of the subsurface formations for a qualitative indicator of the presence or absence of hydrocarbons therein. One property of the subsurface formations which is of particular interest is the porosity. Porosity is the fraction, as a percent, of volume occupied by minute channels or open spaces. The total porosity includes all of the interstices or voids, whether interconnected or not. However, the porosity measurement ordinarily used in reservoir studies is the ratio of the interconnected pore space to the total bulk volume of the formation, termed as effective porosity.

There is wide variation among reservoirs in the size of the individual pores and in the arrangement of the pores with respect to one another. The variations are affected by a number of elements which have happended to the formation since it was deposited including compaction and cementation due to the pressure of an increased load acting upon the reservoir sediments. Compaction and cementation are especially significant in a reservoir having sediment containing shales, clays or colloidal materials. Large amounts of absorbed water are squeezed out of these materials by pressure and because clays and colloids are highly plastic, they flow between the grainss to form a cementing or bonding agent and thereby reduce the porosity.

Compaction of reservoir rock is of two kinds, plastic and elastic. Plastic compaction is the squeezing of the soft accessory minerals of the formation matrix, such as clays, weathered products and colloids, into the open pore spaces as the result of pressure increases with the water being driven out. The result is a loss of porosity, a reduction in permeability and an over-all lessening of rock volume.

Most plastic compaction occurs during the digenesis of the formation, when the high water content is being removed. Long continued pressures undoubtedly maintain the process of plastic pore reduction long after digenesis, though at a progressively slower rate. Thus, in sandstones, plastic compaction is evidenced by the squeezed, strained, and deformed soft minerals, by rearrangement of the grains and by closer adjustment of the same grains to the matrix material.

A rock that has undergone elastic compaction can, when the load pressure is reduced, return at least partially to the original volume. Such return is most likely to occur in a firm sandstone. However, in most sandstone, pore space also permanently decreases with an increase in the weight of the overburden, since they commonly contain clay minerals. These clays are squeezed into the pores held open by the touching sand grains and a closer packing results. Thus, a shaly sand may be expected to have suffered more reduction in pore volume for the same pressure than a clean sand.

As the weight of the overburden increases and persists over geological time, the average shale porosity will continue to decrease. Compaction is greater in clays and shales than in sands because of the plastic nature of the clays and because the clays have been swollen by water absorbed into their particles and by water contained in the molecular structure of their crystal plates.

Accordingly, to determine the location and feasibility of recovery of subsurface hydrocarbons, knowledge of the formation porosity is a necessary element. To determine porosity various logging methods have been derived to yield a qualitative indication of porosity, among them are acoustic logging, density logging, and neutron logging. However, each of the logging methods is adversely affected to some degree by borehole conditions. For example, subsurface gas formations will distort the logging signals obtained using density logging. Additionally, washouts and borehole rigosity will give abnormal readings which tend to obscure useful information approximate to the washout.

Compaction trends based on previous logging data have been developed for geologic areas showing the change of total porosity with relation to depth. These trends can be helpful in estimating the effective porosity of a specific reservoir when no porosity log is available or can be used in evaluating the quality of a porosity log when available. However, these depth trends do not adequately take into account compacting and cementing of specific reservoirs caused by the weight of the overburden. Thus, there has been provided no reliable method for estimating the effective porosity of a specific reservoir where no porosity log is available or for evaluating the quality of the porosity log, when available.

Accordingly, the present invention overcomes the deficiencies of the prior art by providing a method and an apparatus for utilizing information derived for correlation of data for a geological formation to provide an effective porosity log which can be recorded or can be used for comparison with a field record made from an actual logging run to determine the areas of inaccuracy or to correct any such inaccuracy.

SUMMARY OF THE INVENTION

A clay content curve, for the borehole under investigation is developed through logging procedures such as use of a gamma ray log or a spectral gamma ray log. The information received from the logging instrument relating to the clay content, also known as the shaliness indicator, is utilized to produce a clay content curve. Additionally, compaction trend curves based upon historic logging data are obtained for the geologic area of interest. If the lithology of the formation of interest is shaly, bulk density trends related to depth are utilized in producing the curve necessary. For sandstones data of porosity versus depth trends are used in producing a total porosity estimate.

Information from the total porosity trend curve is corrected using a function of the shaliness indicator curve. This correction allows the derivation of an effective porosity log for a reservoir which can be recorded or can be used as a quality indicator by comparison to logging runs of porosity instruments. This comparison permits quality control of field recorded porosity logs or the derived log may be used as a substitute for portions of the field porosity log obtained under severe well conditions. These well conditions include, but are not restricted to washout control, data pre-editing, gas detection, silt percentage evaluation.

Accordingly, it is a feature of the present invention to provide new and improved methods and apparatus for determining the effective porosity of subsurface formations surrounding earth boreholes;

it is also a feature of the present invention to provide new and improved methods and apparatus for obtaining an effective porosity measurement which can be used in editing formation porosity logs;

it is yet another feature to provide method and apparatus for determining the quality of subsurface formation porosity measurements;

still another feature of the present invention is to provide a shaliness correction for total porosity depth trends for determining the effective porosity of subsurface formations.

It is yet another feature of the present invention to provide a method and an apparatus for utilizing a function of a clay content measurement to correct historic porosity trends in estimating the effective porosity of formations.

The advantages of the present invention will be more readily understood by those skilled in the art from a reading of the following detailed description.

DETAILED DESCRIPTION OF THE PREFERRED EMBODIMENT

The amount and variation of porosity in clastic sediments, i.e. sand-shale sequences, depends on several variables. One important parameter affecting total porosity is due to the depth-dependent overburden pressure referred to as the depth of burial. Hence, provided one has knowledge of the compaction trends for sand and shale prevailing in a given geologic province, the effective reservoir porosity can be determined at any given depth within a borehole by using an independent method of determining the total shale volume.

Compaction of a reservoir rock is due chiefly to the increasing weight of the overburden. Its effect, like that of cementation, is to reduce porosity. Compaction is especially significant in reservoir sediments containing shales or clays and colloidal material. Large amounts of absorbed water are squeezed out of these by pressure, and because the clays and colloids are highly plastic, they flow between the grains to form a cementing or bonding agent and thereby reduce the porosity. Clean sandstones found in some of the deepest wells, drilled below 15,000 feet, show no evidence of crushing, which indicates that such rocks may prove productive at great depths, whereas muddy or dirty sandstones would be made impermeable by pressure at far shallower depths. Even in clean sandstones, however, there is evidence that the number of grain contact points increases with depth, which means that pore space decreases downward.

Compaction of a reservoir rock is of two kinds, plastic and elastic. Plastic compaction is the squeezing of the soft accessory minerals of the matrix, such as clays, weathered products, and colloids, into the open pores as the pressure increases and the water is driven out. The result is a loss of porosity, a reduction of permeability, and an over-all lessening of the rock volume. Most plastic compaction occurs during the digenesis of the rock, when the high water content is being removed. Long-continued pressures, however, undoubtedly maintain the process of plastic pore reduction long after digenesis, though at a progressively slower rate. Cementation, as well as compaction, plays a part in this reduction, and it becomes difficult if not impossible to separate the two processes. In sandstones, plastic compaction is evidenced by the squeezed, strained, and deformed soft minerals, by rearrangement of the grains, and by closer adjustment of the same grains to the matrix material. A rock plastically deformed does not return, even in part, to the original volume. The volume of such a rock is therefore a function of the highest pressure it has undergone during its geologic life.

Most of the reduction in volume comes within the clay and shale sediments. Freshly deposited clay may have a porosity of over 50 percent and averages around 27 percent. By the time the clays have become indurated into shales, the average porosity will have decreased to about 13 percent, largely as a result of the pressure from the weight of the overburden. As the weight of the overburden increases and persists over geologic time, the average shale porosity will continue to decrease, although at a slower rate, and at depths of 5,000–7,000 feet it may be expected to range between 5 and 10 percent. The compaction is greater in clays and shales than in sands because of the plastic nature of the clays and the fact that many of them have been swollen by the water absorbed onto their particles and by planar water contained within the molecular structure of their crystal plates. The removal of this water means an equivalent in rock particle volume.

Sandstones also may lose pore space with an increase in the weight of the overburden, since they commonly contain some clay minerals. These clays are squeezed into the pores held open by the touching sand grains, and a closer packing results. Thus, a shaly or "dirty" sand may be expected to have suffered more reduction in pore volume for the same pressure than a clean sand. A clean sand would be expected to have reserved more of its porosity and permeability against the increase in overburden pressure during geologic time than a shaly sand. A deeply buried sand that is clean is therefore more attractive as a potential reservoir rock than a shaly or muddy sand.

As becomes apparent from the above discussion, the porosity parameter may be defined as the ratio of pore volume in bulk volume and is directly related to overburden pressure in hydrostatically pressured geologic sequences. Basically, an increase in overburden results in a decrease in pore volume. Such compaction trends can be derived for shales and also for sandstones from logging data, for example, plotting the bulk density values of shales and sands versus depth. Such trends can be determined from logging data for any area.

BRIEF DESCRIPTION OF THE DRAWINGS

FIG. 1 is illustrative of the generalized relationship of reservoir total porosity and bulk density trends versus depth for a geologic province. These trends are dependent upon several parameters including geologic age, depth of burial, lithology, cementation and formation pressure.

Besides the specific compaction trends for a given area there is required a shaliness measurement. The latter is calculated from gamma ray or, preferentially, spectral gamma ray data, pulsed neutron information, or from any other more conventional shaliness indicators.

Figure 1:
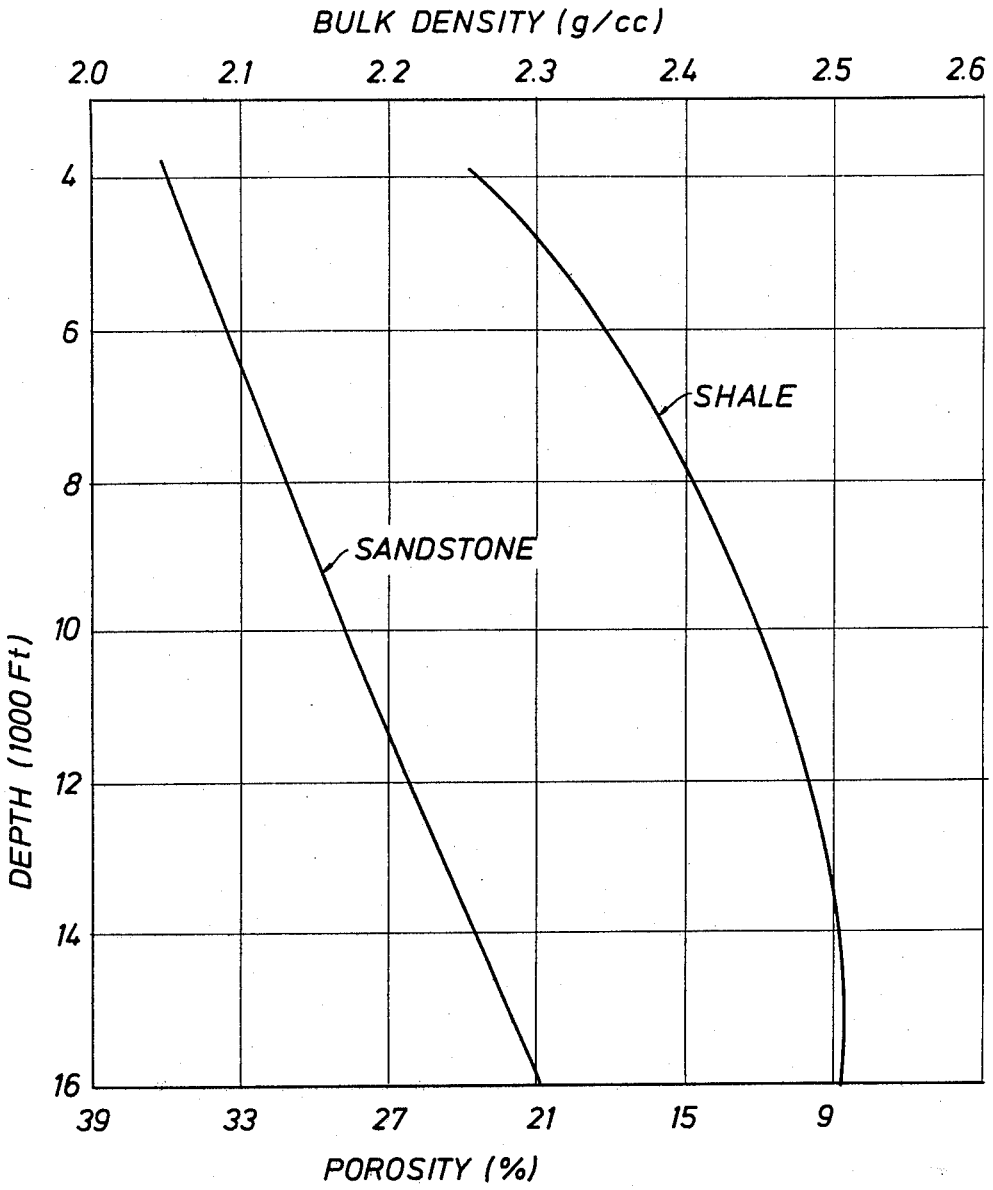
FIG. 1 is a graph of total parosity and bulk density trends versus depth.
Figure 2:
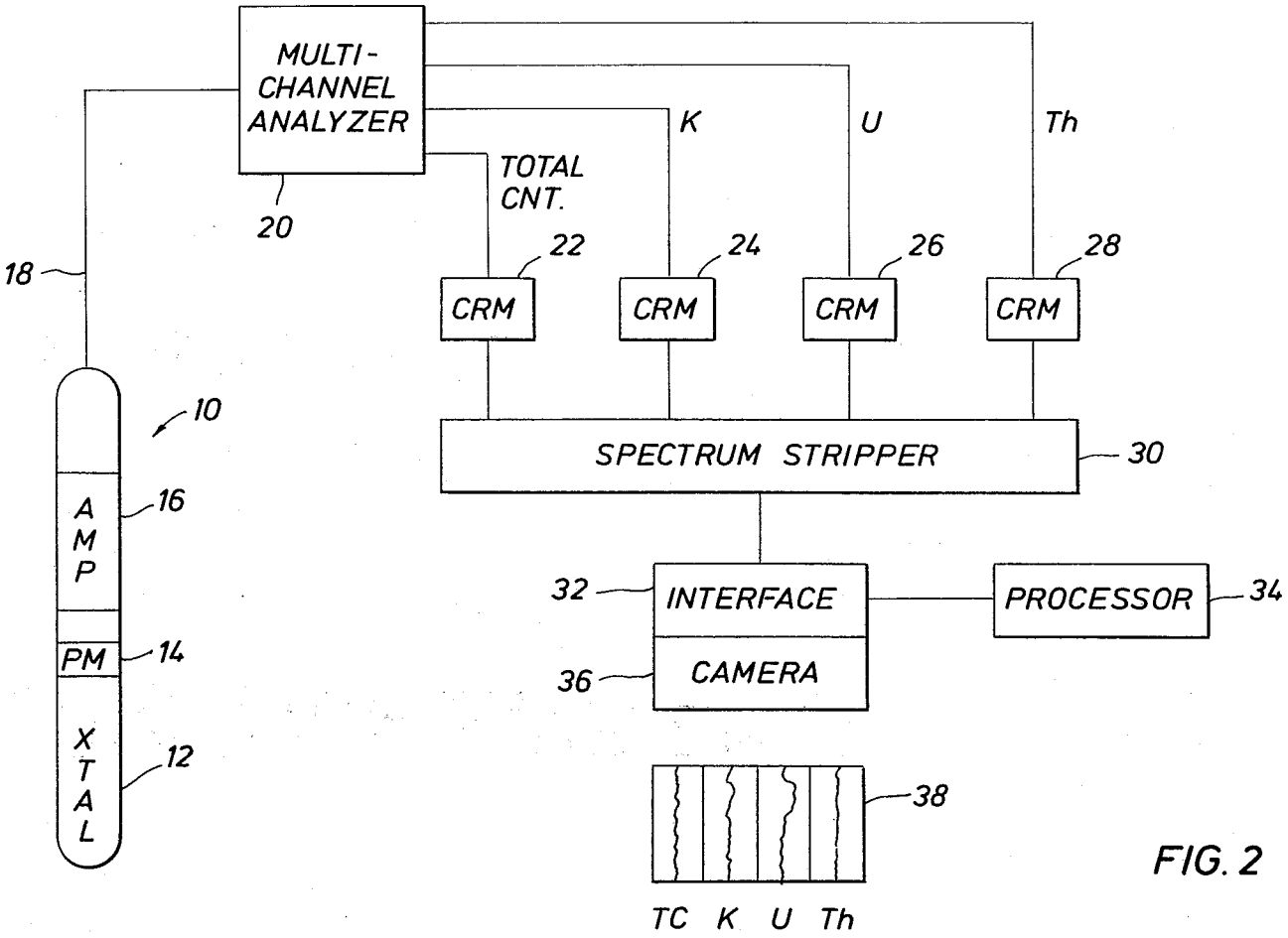
FIG. 2 shows the logging instrument and related elements of the present invention.

Referring now to FIG. 2, a logging instrument 10 is shown to include a high-resolution gamma spectrometer comprised of a large cylindrical sodium-iodide, thallium-activated crystal 12 which is optically coupled with a photo multiplier tube 14 for producing output electrical signal representative of natural gamma radiation measured by passing logging instrument 10 through a borehole (not shown) penetrating earth formations (not shown).

Natural gamma radiation from various sources within the earth formation impinges upon scintillation crystal 12, producing light flashes therein whose intensity is proportional to the energy given up by the collision of the gamma ray with the crystal, thereby causing the scintillation. The light flashes thus produced are detected by the photo multiplier tube 14 which produces an electrical pulse whose amplitude or voltage level is proportional in intensity of the above-described resultant flash.

These electrical voltage signals, in the form of pulses, are coupled into amplifier 16 for amplification and transmission to the surface on a conductor 18 which forms a component of a conventional well logging cable (not shown). The amplified voltage pulses, representative of the energy in the naturally occurring gamma radiation in the earth formations, are coupled into a multi-channel analyzer 20 which sorts gamma radiation occurring from the radioactive decay of potassium, uranium and thorium. Additionally, a fourth energy channel containing the total radiation, potassium, uranium and thorium channels are each coupled into a count rate meter, 22, 24, 26 and 28 respectively. Each meter 24, 26 and 28 accumulates a background-corrected count rate for the particular radioactivity associated therewith, with count rate meter 22 accumulating the total number of gamma rays detected by crystal 12 to provide an indication of the total gamma ray count rate.

Accordingly, the multi-channel analyzer, acting through the count rate meters, provides output signals representative of the number of counts occurring in each energy channel. Each count number is characteristic of the respective radioactive decay of potassium, uranium and thorium atoms in earth formations. These output signals are coupled into a spectrum stripper 30. As is known in the art, spectrum stripper 30 may comprise a small general purpose digital computer.

Spectrum stripping refers to the process whereby background count rates are electronically subtracted in a mathematical process from the potassium and uranium channels in the stripper 30. As a result of having the highest energy level, the thorium count rate is not stripped and may be used for further processing or forming a log directly. Thus, the stripping process is only necessary in the potassium and uranium channels as a result of the addition therein of energy-degraded thorium and, in the case of the potassium channel, uranium gammas. Count rates in the potassium and uranium channels that are obtained solely from energy-degraded thorium gammas are subtracted from the count rates due to the elements themselves. A similar procedure for stripping energy-degraded uranium gammas from the potassium channel count rate is also performed. In this way, accurate concentrations of potassium, uranium and thorium are determined. Techniques for determining the amount of stripping required are well known in the art and will not be discussed in detail here. It will suffice to state that the spectrum measured by instrument 10 during a traverse of subsurface borehole is compared against spectral standards supplied from a standard spectrum data source (not shown) in which the gamma spectrum of known standard elements may be quantatively compared with that of the unknown earth formation penetrated by the borehole. Accordingly, coefficient representative of the fraction of the gamma ray spectrum caused by the standards as an estimate of the borehole radiation may be derived for use in the stripping process.

The total gamma energy spectrum signal along with the stripped energy spectrum signals for potassium, uranium and thorium are coupled into an interface unit 32. Unit 32 provides the interface necessary to couple the signals to various processing and/or display equipment such as a processor 34 or a logging camera 36 for the subsequent processing which comprises the method of applicant's invention.

In the preferred embodiment of the invention the compaction trend and shaliness indicator are combined to yield the effective reservoir porosity as follows:

$$\phi_e = \phi_t - f(Vsh) \tag{1}$$

where $\phi_t$ is the sandstone porosity trend for a geologic province based on historic porosity data and Vsh is the clay content measurement for the reservoir of interest, also referred to as the shaliness indicator.

As previously stated, the shaliness indicator can be derived by use of several logging methods including natural gamma ray logging or preferably spectral analysis logging. When utilizing natural gamma ray logging techniques the shaliness indicator is established according to the following relationship:

$$Vsh = (GR - GRmin)/(GRmax - GRmin) \tag{2}$$

where GRmin is the total gamma radiation measurement in clean sand zones and GRmax is the total gamma radiation measurement in a pure shale zone. Similarly, when utilizing spectral gamma ray logging methods the shaliness indicator is established as follows:

$$Vsh = (A - Amin)/(Amax - Amin) \tag{3}$$

where A is the spectral measurement of interest which can be comprised of total gamma radiation, or a measurement representative of potassium (K), thorium (Th), or uranium (U) content.

Returning to Equation 1, it is seen that to establish effective porosity, total porosity is corrected by a function of the shaliness indicator. The function (f) is based on bulk density data for the geologic province. The function is expressed as:

$$f = \rho_{ma} - \rho_{sh}/\rho_{ma} - 1.0 \tag{4}$$

where $\rho_{ma}$ is the grain density of the formation matrix and $\rho_{sh}$ is the density of the shale material.

As has herein been explained by utilizing compaction trends for the area based on porosity and density logging measurements and a spectral gamma ray log or natural gamma ray log for a specific reservoir there can be developed a porosity log curve, which can then be recorded and can be used to compare to actual porosity logging curves. If required such actual logs can be corrected or edited using a log so derived.

This comparison allows a quality control of field-recorded porosity logs. Furthermore, apparent differences between the log responses are helpful in evaluating well conditions. These include but are not restricted to the following: wash-out control, i.e., data pre-editing, gas detection, silt percentage evaluation, use in lieu of "bad" logs under severe hole conditions and limited logging suites support.

While a particular embodiment of the present has been described, it will be apparent to those skilled in the art that changes and modifications may be made without departing from this invention in its broader aspects. For example, instead of utilizing a measurement of total gamma ray radiation or a measurement of potassium, uranium or thorium, there can be used to derive the shaliness indicator a combination of these measurements. Such combination of measurements can comprise (K+Th/total counts), K/(Th+U), K/Th, U/K or K+Th.

The embodiments of the invention in which an exclusive property or privilege is claimed are defined as follows:

1. A method for determining the effective reservoir porosity of earth formations traversed by a borehole within a geologic region, comprising the steps of:

establishing a porosity compaction trend for said geologic region;

establishing a bulk density compaction trend for said geologic province;

generating an electrical signal functionally related to the clay content of said earth formations traversed by said borehole;

generating a functional relation between said bulk density compaction trend and said clay content signal; and correcting said porosity compaction trend for said geologic province by said functional relation of said bulk density compaction trend and said clay content signal to determine the effective reservoir porosity of said earth formations.

2. The method of claim 1 wherein said clay content signal is generated by measuring the radioactive nuclides occurring naturally in said earth formations.

3. The method of logging of claim 2 wherein the step of correcting said porosity compaction is of the form $$\phi e = \phi t - f(Vsh)$$

where $\phi e$ is the effective reservoir porosity.

4. The method of logging of claim 3 wherein the functional relation between said bulk density compaction trend and said clay content signal, is of the form $$f(Vsh) = \frac{(\rho ma - \rho sh)}{(\rho ma - 1.0)} \times \frac{(A - A\min)}{(A\max - A\min)}$$

where $\rho ma$ represents the grain density of the formation matrix, $\rho sh$ the density of the shale material, and A the measurement of said radioactive nuclides within said formations.

5. The method of claim 4 wherein said measured radioactive nuclide corresponds to natural gamma radiation produced by potassium.

6. The method of claim 4 wherein said measured radioactive nuclide corresponds to natural gamma radiation produced by thorium.

7. The method of claim 4 wherein said measured radioactive nuclide corresponds to natural gamma radiation produced by uranium.

8. The method of claim 4 wherein said measured radioactive nuclide corresponds to natural gamma radiation produced by at least two radioactive elements.

9. The method of logging of claim 3 wherein the functional relation between said bulk density compaction trend and said clay content signal, is of the form $$f(VSH) = \frac{(\rho_{ma} - \rho_{sh})}{(\rho_{ma} - 1.0)} \times \frac{(GR - GR_{min})}{(GR_{max} - GR_{min})}$$

where $\rho_{ma}$ represents the grain density of the formation matrix, $\rho_{sh}$ the density of the shale material, and GR the measurement of the naturally occuring gamma radiation within said formations.

10. The method of claim 4 or 9 wherein said effective reservoir porosity value is recorded as a function of borehole depth.

11. A method for porosity logging of earth formations traversed by a borehole within a geologic region, comprising the steps of:

establishing a porosity compaction trend from previous logging measurements for said geologic region;

establishing a bulk density compaction trend from previous logging measurements for said geologic province;

generating an electrical signal functionally related to the clay content of said earth formations traversed by said borehole;

generating a functional relation between said bulk density compaction trend and said clay content signal;

correcting said porosity compaction trend for said geologic province by said functional relation of said bulk density compaction trend and said clay content signal to determine the effective reservoir porosity of said earth formations;

deriving a porosity logging measurement for said formations traversed by said borehole; and comparing said effective reservoir porosity measurement with said porosity logging measurement.

12. A method for determining the effective porosity of earth formations traversed by a borehole within a geologic region; comprising:

deriving measurements functionally related to the shaliness of said earth formations traversed by said borehole; and combining said shaliness measurements with a compaction trend for said geologic region to provide an indication of the effective porosity of said earth formations.

13. The method of claim 12 wherein said shaliness measurements are derived for detecting gamma radiation emitted by said earth formations.

14. The method of claim 13 wherein said gamma radiation are representative of radioactive nuclides occurring naturally in said earth formations.

15. The method of claim 14 wherein said compaction trend is produced by combining a shale bulk density trend and a sandstone porosity trend and relating said trends to depth.

* * * * *